United States Patent [19]

Sekiguchi

[11] 4,152,889

[45] May 8, 1979

[54] PUSH BUTTON DEVICE FOR WATCH CASING

[75] Inventor: Tsunetoshi Sekiguchi, Sayama, Japan

[73] Assignee: Citizen Watch Co., Ltd., Tokyo, Japan

[21] Appl. No.: 815,237

[22] Filed: Jul. 13, 1977

[51] Int. Cl.[2] ..... G04B 37/08

[52] U.S. Cl. ..... 58/90 B

[58] Field of Search ..... 58/23 R, 50 R, 85.5, 58/90 R, 90 B

[56] References Cited

U.S. PATENT DOCUMENTS

| | | | |
|---|---|---|---|
| 3,357,173 | 12/1967 | Wyssen | 58/90 B X |
| 3,362,154 | 1/1968 | Perret | 58/90 B X |
| 3,389,551 | 6/1968 | Wyssen | 58/90 B |
| 3,757,512 | 9/1973 | Zellweger | 58/90 B |
| 3,977,178 | 8/1976 | Wenger | 58/90 B |

*Primary Examiner*—Stanley J. Witkowski
*Attorney, Agent, or Firm*—Sherman & Shalloway

[57] ABSTRACT

A push button device for a watch casing comprising a watch casing, a through hole formed on a side wall of the watch casing, through which a push button is inserted to be secured, a pipe fitted to the through hole and provided and a guide surface inside the outer edge thereof, the push button having a pushing portion at one end thereof and a groove at the other end thereof and an engaging ring elastically deformable and fitted to the groove. The engaging ring locks the button in position thereby providing useful and effective push button device for a watch casing which is easy to assemble and is low in cost.

9 Claims, 6 Drawing Figures

PUSH BUTTON DEVICE FOR WATCH CASING

BACKGROUND OF THE INVENTION

1. Field of the Invention

This invention relates to a push button device for use in a watch casing to externally actuate the internal mechanism in the watch.

2. Prior Art

Heretofore, there has been proposed a push button device in a watch having the structure, as shown in FIG. 1, in which a push button 1 is attached to a pipe 2 and a snap ring 3 is fixed to a groove on the periphery of the push button 1 so that the push button 1 is prevented from coming out from the pipe 2. However, this conventional push button device has a shortcoming in that assembly is difficult since the minute snap ring 3 has to be fixed to the minute groove 4.

OBJECT OF THE INVENTION

An object of the invention is to provide a useful and effective push button device for use in a watch casing in which the above defect is obviated.

Another object of this invention is to provide an improved push button device for use in a watch casing which is easy to assemble and has a low manufacture cost.

Another object of this invention is to provide a new push button device for use in a watch casing which is thin in.

A further object of this invention is to provide a push button device for use in a watch in which the length of the pipe can be made shorter than that of the prior art so that there may be provided a watch with a thin side wall and, as the result, common pipes are able to be used for all types of watch casings.

PREFERRED EMBODIMENT OF THE INVENTION

Figure 1:
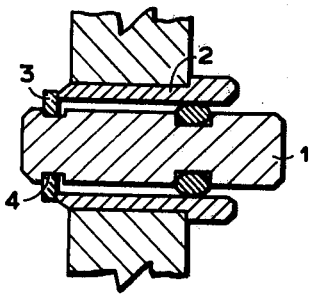
FIG. 1 (PRIOR ART)
FIG. 1 is a partial section showing parts of the prior art push button devices for a watch casing.
Figure 2:
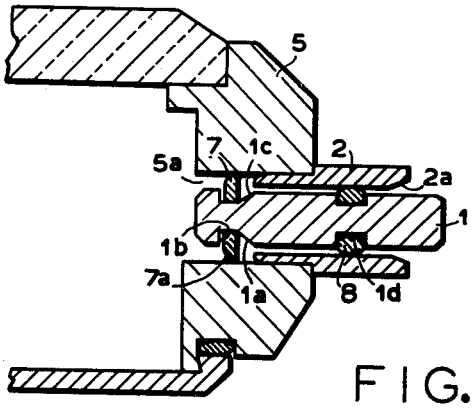
FIG. 2 is a partial section showing parts of a push button device for a watch casing according to one embodiment of this invention.
Figure 3:
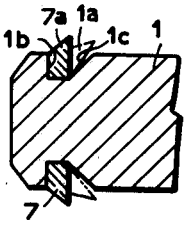
FIG. 3 is an enlarged and partial section of the push button and the ring shown in FIG. 2.

FIGS. 2 and 3 show one embodiment of a push button device according to this invention, wherein like references depict like parts in FIG. 1. A pipe 2 is compulsorily inserted into and fixed to a through hole 5*a* formed at a side wall of a watch casing 5. Inside an external edge of the pipe 2 there is provided slanting guide surface 2*a* to make a flat ring 7 easy to be inserted therethrough. A push button 1 is fitted to the interior of the pipe 2 and is provided at the edge of its internal portion with a groove 1*a*, the flat ring 7 being attached. The groove 1*a* is shaped such that one side face 1*b* is vertical to the axis of the push button 1 and other side face 1*c* is at a slant thereto. The push button 1 has a ring-shaped groove 1*d* at its periphery which depresses an O-shaped ring 8 together with the internal face of the pipe 2. The flat ring 7 is compulsorily attached to the groove 1*a* on the periphery of the push button. The flat ring is made of fairly hard materials, i.e., hard rubber, synthetic resin, different from butyl rubber which is used for waterproofing. The flat ring 7 has an outer edge designed such that its diameter is a little longer than that of the interior of the pipe 2 and a slanting face 7*a* is formed at the inner side of the push button 1. The face 7*a* is tongue-shaped.

In assembling the above-described push button 1 in a watch casing, the flat ring 7 is attached to the groove 1*a* on the push button 1 and the O-shaped ring 8 is fitted to the ring-shaped groove 1*d* thereon, respectively. The push button 1 is then forcibly inserted from the outside of the watch casing 5 into the pipe 2 which is in a through hole in the peripheral wall of the casing 5. The slanting faces 2*a* and 7*a* function as guide means. Thus as shown in phantom in FIG. 3, the outer edge of the flat ring 7 shaped in a tongue is located in a space at the side of the slanting surface formed on the groove 1*a* of the push button 1. In this case, it is easy to insert the flat ring 7 into the pipe 2 even if use is made of a comparatively hard ring since the space is formed in the groove 1*a*. After passing through the interior of the pipe 2, the outer edge of the flat ring 7 returns to the initial position. When its flat ring 7 is located at the inner internal edge 2*a* of the pipe 2, the push button 1 enters the interior of the pipe 2. Even if the outer edge of the flat ring 7 impacts the internal edge of the pipe 2, the flat ring 7 contacts the vertical side wall 1*b* in the groove 1*a* so that the outer edge of the flat ring 7 cannot disengage. Furthermore, the push button never falls down from the pipe 2 since the side surface of the flat ring 7 which contacts the pipe 2.

Figure 4:
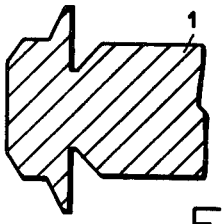
FIG. 4 is a modified embodiment of the push button and the ring of FIG. 3.

FIG. 4 shows a modified embodiment of the push button 1 and the flat ring 7 as shown in FIG. 3 in which the flat ring is made intergral with the push button. This type has further advantages in that the process of assembling the flat ring 7 into the push button 1 may be abbreviated resulting in a push button device low in cost.

Figure 5:
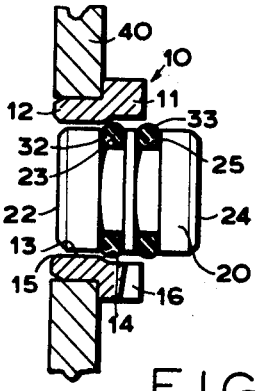
FIG. 5 is a modified embodiment showing the brief parts of FIG. 2.
Figure 6:
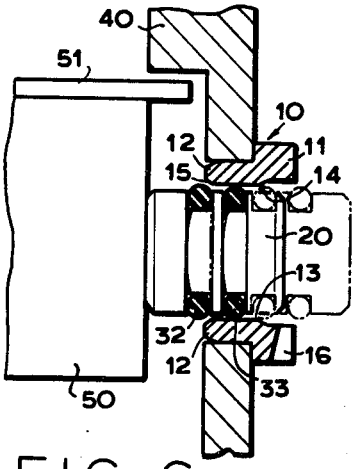
FIG. 6 is a further modified embodiment showing the brief parts of FIG. 2 in which further a dial and a watch movement are shown.

FIGS. 5 and 6 are other modified embodiments of the push button device of FIG. 2 wherein reference numeral 10 denotes a pipe 10, 20 a push button, 32 an engaging rubber ring and 33 an O-shaped ring for waterproof. The pipe 10 is inserted into a through hole of the side wall on the watch casing 40 so as to be secured thereto. Guide surfaces 14 and 15 are formed on the outer and inner edges 11 and 12 of the pipe 10 respectively. The guide surface 14 is comparatively gently-sloping such that the engaging rubber ring 32 and the O-shaped ring 33 for waterproofing are easily inserted into the interior of the pipe 13. The guide surface 15 is formed in a curved surface such that the engaging rubber ring 32 usually does not come out, but may be reinserted into the interior 13 of the pipe 10 by a suitable pushing force. Reference numeral 16 illustrates a cut-off portion for actuating the push button 20.

Adjacent to a contacting portion 22 of the push button 20, there is formed a first groove 23 thereto the engaging rubber ring being attached. There is formed between the groove 23 and the face 24 a second groove 25 thereto the waterproof O-shaped ring being attached.

The engaging rubber ring 32 is made of NBR (nitrile rubber), polyurethane rubber, etc. and usually contacts the inner edge 12 of the pipe 10 so as to prevent the push botton 20 from coming out. When a suitable depressing force is imposed on the rubber ring 32, the engaging rubber ring 32 elastically deforms along the small guide surface 15 on the pipe 10. Here the suitable depressing force is larger than one with which the push button 20 is pushed out from the pipe 10 by the internal pressure under reduced pressure when there is effected a waterproof test of the watch casing 40. But it is smaller than one with which the push button 20 is pushed out from the pipe 10 by means of a pincette, etc. This suitable force can be obtained by suitably setting a combination of shape and hardness of the engaging rubber ring 32, shape of the small guide surface 15, etc.

A waterproof O-shaped ring 33 is made of NBR and attached to a second groove 25 on the push button 20. The O-shaped ring 33 provides a waterproof function with compulsorily being contacting the inner wall 11 of the pipe 10. In order that the push button 20 is attached to the pipe 10, the engaging rubber ring 32 and the waterproof O-shaped ring 33 are previously fitted to the first and second grooves 23, 24 respectively. Then the push button 20 is inserted into the pipe 10 from the exterior of the watch casing 40 and it may be arranged such that the engaging rubber ring 32 is positioned inside the inner edge of the pipe 10.

Thus, the contacting portion 22 of the push button 20 is strongly depressed by means of a pinsette, etc. so that the push button 20 may be pulled out from the pipe 10. The engaging rubber ring 32 once contacts the guide surface 15 on the pipe 10 and elastically deforms by an exessive pushing force so as to be pressed in the internal wall 12 on the pipe 10 and thereby being pressed out toward the exterior of the pipe 10.

According to this embodiment the push button 20 is usually used at the position (indicated by a real line in FIG. 6) where the engaging rubber ring 32 contacts the inner edge 12 of the pipe 10. Therefore, the push button 20 is never moved even if the exterior of the watch casing 40 is reduced in a waterproof test, etc. Furthermore, a movement 50 may be taken off from the casing 40 by pushing out the push button 20 to the position (indicated by a dotted line in FIG. 6) outside the outer periphery of a dial 51.

In this point, the conventional push button device requires further the length of the internal wall 13 of the pipe 10 which is enough long for waterproofing to be maintained.

On the other hand, the push button device of the present invention makes it possible that the length of the internal wall 13 on the pipe 10 is made shorter by the movement stroke because the engaging rubber ring 32 contacts the inner edge 12 of the pipe 10 so as to prevent the push button 20 from moving.

According to this invention there may be provided a push button device easy in assembling and low in manufacturing cost.

What is claimed is:

1. A push button device for a watch comprising:
(a) a watch casing having a through hole therein;
(b) a pipe having a first portion with an outside diameter substantially equal to a diameter of the through hole and fitted into the through hole and a second portion with an outside diameter greater than the diameter of the through hole and projecting from the through hole;
(c) a push button inserted into the pipe and provided with first and second grooves therein;
(d) an elastically deformable engaging ring fitted about the first groove and having an outside diameter greater than an inside diameter of the first portion; and
(e) a waterproofing ring fitted about the second groove and having an outside diameter substantially equal to an inside diameter of the pipe.

2. The push button device of claim 1 wherein the outside diameter of said elastically deformable ring is substantially less than or equal to the diameter of the through hole.

3. The push button device of claim 1 wherein the second portion of said pipe has a tapered inner edge forming a guide surface permitting insertion of said push button fitted with said rings into said pipe.

4. The push button device of claim 3 wherein said first groove has a first side wall (1*b*) perpendicular to an axis of said push button and a second side wall (1*c*) slanted away from said first side wall forming an opening within which said engaging ring will elastically deform when said push button fitted with said rings are inserted in said pipe.

5. The push button device of claim 4 wherein said engaging ring has a slanting face (7*a*) whereby insertion of said push button fitted with said rings into said pipe results in the guide surface of the pipe engaging the slanting face (7*a*) and elastically deforming said engaging ring.

6. The push button device as defined in claim 5, wherein said engaging ring is a flat ring.

7. A push button device for a watch comprising:
(a) a watch casing having a through hole therein;
(b) a pipe having a first portion with an outside diameter substantially equal to a diameter of the through hole and fitted into the through hole and a second portion with an outside diameter greater than the diameter of the through hole and projecting from the through hole;
(c) a push button inserted into the pipe and provided with first and second grooves therein;
(d) a waterproofing ring fitted about the second groove and having an outside diameter substantially equal to an inside diameter of the pipe;
(e) said push button further includes a slanted protrusion located adjacent said first groove whereby insertion of said push button into said pipe results in the slanted protrusion being deformed into the first groove.

8. The push button device of claim 7 wherein the second portion of said pipe has a tapered inner edge forming a guide surface for engaging the tapered protrusion of the push button.

9. The push button device of claim 7 wherein said first groove has a first side wall perpendicular to an axis of said push button and a second side wall slanted away from said first side wall and said slanted protrusion has a slanted wall parallel with the second side wall and the first side wall of the first groove extends to meet the slanted wall to form said slanted protrusion.

* * * * *